US010421049B2

(12) United States Patent
Coric et al.

(10) Patent No.: US 10,421,049 B2
(45) Date of Patent: Sep. 24, 2019

(54) BUCKET MIXER INSERT

(71) Applicant: TRANSFORM SR BRANDS LLC, Hoffman Estates, IL (US)

(72) Inventors: Milos Coric, Lincolnshire, IL (US); Colin Knight, Winnetka, IL (US)

(73) Assignee: TRANSFORM SR BRANDS LLC, Hoffman Estates, IL (US)

( * ) Notice: Subject to any disclaimer, the term of this patent is extended or adjusted under 35 U.S.C. 154(b) by 446 days.

(21) Appl. No.: 14/517,640

(22) Filed: Oct. 17, 2014

(65) Prior Publication Data

US 2016/0107131 A1 Apr. 21, 2016

(51) Int. Cl.

| | |
|---|---|
| ***B01F 9/06*** | (2006.01) |
| ***B01F 11/00*** | (2006.01) |
| ***B01F 13/00*** | (2006.01) |
| ***B01F 15/00*** | (2006.01) |
| ***B28C 5/18*** | (2006.01) |

(52) U.S. Cl.

CPC ..... *B01F 9/06* (2013.01); *B01F 11/0002* (2013.01); *B01F 13/0033* (2013.01); *B01F 15/00506* (2013.01); *B01F 15/00512* (2013.01); *B01F 15/00883* (2013.01); *B28C 5/1893* (2013.01)

(58) Field of Classification Search

CPC ..... B01F 15/0074; B01F 13/003; B01F 9/06

USPC ..... 366/56, 57, 59, 130, 225–228, 343, 605

See application file for complete search history.

(56) References Cited

U.S. PATENT DOCUMENTS 1,686,280 A * 10/1928 Keller ..... A23D 7/02 241/169
1,989,019 A * 1/1935 O'Keeffe ..... B01F 11/0002 366/130
2,597,291 A * 5/1952 Clegg ..... A01J 15/04 241/178
2,965,274 A * 12/1960 Brillis ..... B01F 11/0002 229/400
3,140,078 A * 7/1964 Grubb ..... B01F 11/0082 222/136
3,224,742 A * 12/1965 Hiser ..... B01F 13/002 15/246.5
4,253,772 A * 3/1981 Burton-Smith ..... B01F 11/0002 366/130
4,332,482 A * 6/1982 Engler ..... B01F 13/002 366/130
4,552,460 A * 11/1985 Wallace ..... B01F 7/028 222/369
4,664,527 A * 5/1987 Schuler ..... B01F 9/0009 366/141
4,950,082 A * 8/1990 Carlson ..... B01F 9/103 366/130

(Continued)

*Primary Examiner* — Abbas Rashid
(74) *Attorney, Agent, or Firm* — McAndrews, Held & Malloy, Ltd.

(57) ABSTRACT

Apparatuses and methods based thereon are provided for mixing utilizing mixer inserts. A mixer insert may comprise an enclosing component adapted for application to an opening in a container to which the mixer insert is applied, to enclose a space in the container. The mixer insert may further comprise one or more mixing components, adapted to fit within the enclosed space when the enclosing component is applied to the opening in the container, with the one or more mixing components being configured to mix material placed within the enclosed space when the combination of the container and the mixer insert is subject to particular force or movement.

20 Claims, 3 Drawing Sheets

(56) References Cited

U.S. PATENT DOCUMENTS 5,129,855 A * 7/1992 Bruckert ..... A22C 25/02 366/325.92
5,199,788 A * 4/1993 Stallings ..... B01F 7/1695 366/247
5,403,086 A * 4/1995 Lindesay ..... B01F 9/0034 366/227
5,533,802 A * 7/1996 Garganese ..... B01F 11/0082 366/256
5,622,289 A * 4/1997 Dedoes ..... B01F 7/1695 222/472
5,800,058 A * 9/1998 Cook ..... B01F 7/00241 366/306
5,934,800 A * 8/1999 Bonacci ..... B01F 15/0074 366/213
6,350,052 B1 * 2/2002 Storz ..... B28C 5/1893 366/228
6,419,385 B1 * 7/2002 Walls ..... B01F 7/1695 366/247
6,511,218 B2 * 1/2003 Keough ..... B01F 7/1695 366/247
7,159,735 B2 * 1/2007 Morse ..... B25H 3/026 206/427
7,229,204 B2 * 6/2007 Haskell ..... B01F 9/0016 366/224
7,229,656 B2 * 6/2007 Paumen ..... A47J 43/24 134/21
7,384,188 B2 * 6/2008 Waggoner ..... B01F 7/00133 366/247
7,441,422 B2 * 10/2008 Choi ..... D06F 25/00 366/225
7,670,042 B2 * 3/2010 Cheung ..... B01F 9/0016 366/139
2005/0252919 A1 * 11/2005 Morse ..... B25H 3/026 220/528
2012/0063258 A1 * 3/2012 Iverson ..... B01F 7/00583 366/63
2012/0092953 A1 * 4/2012 Fung ..... A23G 9/22 366/343
2013/0182526 A1 * 7/2013 Dertina, Sr. ..... B28C 5/1893 366/56
2013/0272086 A1 * 10/2013 Spray ..... B01F 13/002 366/130
2014/0043931 A1 * 2/2014 Figueroa ..... B01F 13/0011 366/130

* cited by examiner

BUCKET MIXER INSERT

TECHNICAL FIELD

Aspects of the present application relate to buckets, particularly those used in mixing material used in home improvement projects. More specifically, certain implementations of the present disclosure relate to bucket mixer inserts, which may be used to facilitate mixing of material such as cement, such as using commonly available buckets (e.g., 5-gallon buckets).

BACKGROUND

Existing methods and apparatuses, if any exist, for facilitating material mixing at home and/or by private consumer (rather than professional, with professional-type tools) are costly, cumbersome and inefficient. Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY

System(s) and/or method(s) are provided for mixing material by use of container (e.g., bucket) mixer inserts, substantially as shown in and/or described in connection with at least one of the figures, as set forth more completely in the claims.

These and other advantages, aspects and novel features of the present disclosure, as well as details of illustrated implementation(s) thereof, will be more fully understood from the following description and drawings.

DETAILED DESCRIPTION

As utilized herein, the term "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y and z." As utilized herein, the terms "block" and "module" refer to functions than can be performed by one or more circuits. As utilized herein, the term "example" means serving as a non-limiting example, instance, or illustration. As utilized herein, the terms "for example" and "e.g.," introduce a list of one or more non-limiting examples, instances, or illustrations.

Figure 1:
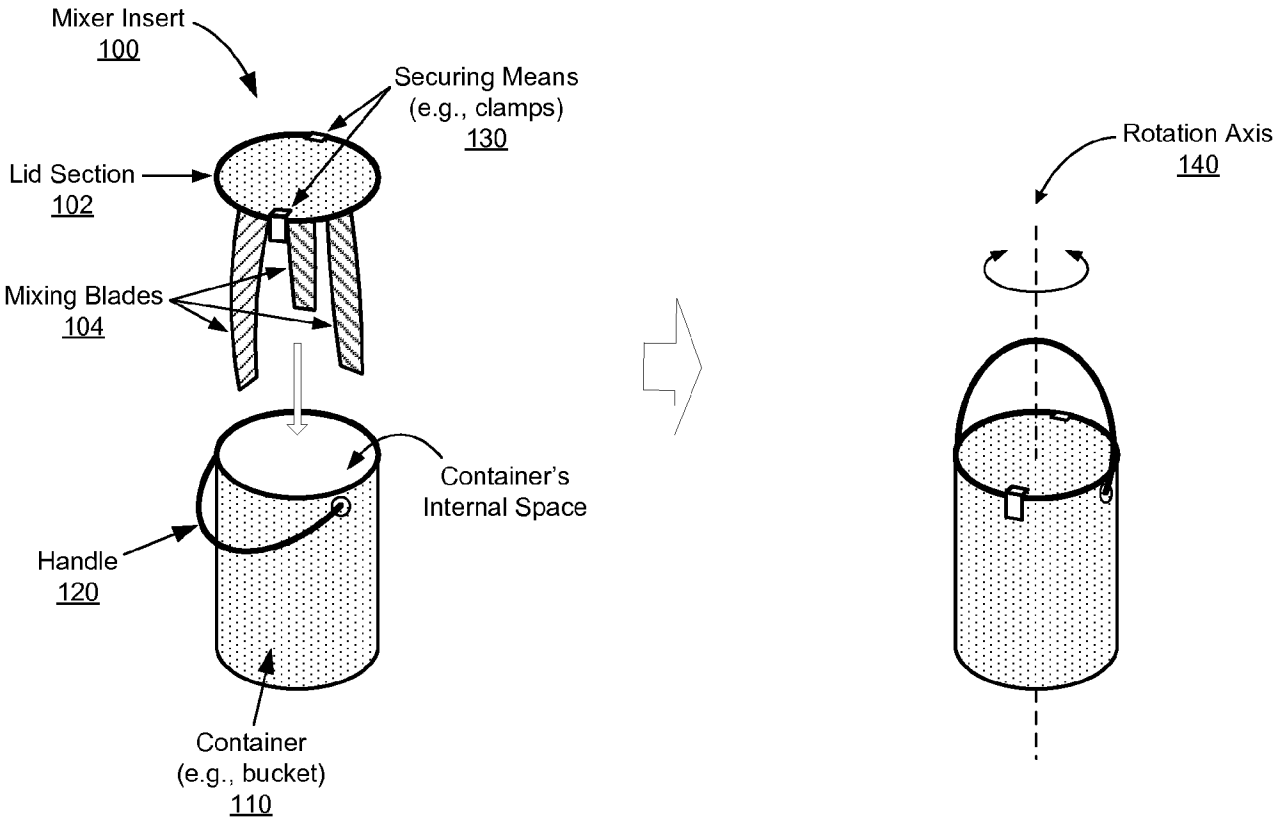
FIG. 1 illustrates an example use of a mixer insert for a bucket, in accordance with an embodiment of the present invention.

FIG. 1 illustrates an example use of a mixer insert for a bucket, in accordance with an embodiment of the present disclosure. Shown in FIG. 1 is a mixer insert 100, which may be implemented in accordance with an example embodiment of the present disclosure.

The mixer insert 100 may be designed and/or manufactured such that it may apply to particular containers, having particular characteristics, such that to enable use of these containers in mixing material (e.g., cement), which may be used during home improvement projects for example. In particular, the mixer insert 100 may facilitate mixing material in a convenient and cost-effective manner, obviating the need to use industrial or professional type of machinery or tools (e.g., expensive cement mixers).

For example, the mixer insert 100 may comprise a lid section 102, which may be used to enclose a space within a corresponding container, and one or more mixing blades 104, which may be used in facilitating the mixing done within the enclosed space. The mixing blades 104 may be designed in various ways, particularly to provide optimal mixing within the enclosed space. A particular implementation is described in more detail below (e.g., FIG. 3).

The containers that may be used in conjunction with mixer insert implemented in accordance with the present disclosure (e.g., the mixer insert 100) need not be limited to any particular design, shape, and/or make. Such containers would minimally need to have, however, a space with an opening such that the mixer insert 100 may be applied to, to facilitating enclosing the space such that the space may be used when mixing material. For example, the container 110 shown in FIG. 1 may be a bucket (e.g., a 5 Gal bucket) which may be abundantly available.

The characteristics of the containers which may make them suitable for use in conjunction with mixer inserts implemented in accordance with the present disclosure (e.g., the mixer insert 100 shown in FIG. 1) may be based on and/or relate to the characteristics of the mixer inserts. Alternatively, the design of the mixer inserts may be based on anticipated characteristics of the containers to be used in conjunction with the mixer inserts. For example, with reference to the example mixer insert 100 shown in FIG. 1, the lid section 102 may be designed to have a circular shape, thus requiring (or corresponding to) containers having similarly sized and/or shaped openings (e.g., opening of the container/bucket 100). Similarly mixing blades 104 may be designed with particular length, thus requiring (or corresponding to) containers having openings with depth that is greater than the length of the mixing blades 104, and/or with openings that are wide enough to fit the mixing blades 104.

In some implementations, handling means (e.g., a handle) may be used to enable and/or ease handling of combinations of the containers and the mixer inserts. For example, with reference to the embodiment shown in FIG. 1, handling means (e.g., handle) 120 may be used to enable and/or ease handling of the combination of the container 110 and the mixer insert 100. The handling means may be used to enable a user (e.g., consumer attempting to use the container/mixer insert to mix some material) to hold the container/mixer insert combination and/or to move it when effectuating the mixing of material.

In some implementations, securing means (e.g., clamps, clips, or the like) may be used to facilitate and/or enhance securing the mixer inserts to the containers. For example, with reference to the embodiment shown in FIG. 1, securing means 130 (e.g., clamps or clips) may be used to secure mixer inserts (e.g., the mixer insert 100) to the containers to which the mixer inserts may apply (e.g., the container/bucket 110). The securing means 130 may be part of the mixer insert, or may be a separate component which may be applied to the mixer insert(s) and/or the corresponding container(s) when needed.

In some implementations, some of the elements of the mixer insert 100 as described herein may be available as separate components. For example, the one or more mixing components (e.g., blades) 102 may be available as separate components (e.g., of various size and/or shapes) that may be attached when needed into an enclosing (e.g., lid) component to provide the overall "mixer insert." This may be desirable to enable using the same enclosing component with varying sized or shaped containers.

The mixer insert 100 may be applied to cheap, readily available containers (e.g., standard 5-gallon bucket), such as when these container and the mixing insert 100 have matching characteristics (e.g., shape and/or size of the container's opening and the insert's enclosing section match; the mixer insert 100 may be secured to the container using the securing means 130; the container being suitable for intended use, etc.). Accordingly, use of the mixer insert 100 may enable converting such cheap, readily available containers into a simple and affordable mixer (e.g., for mixing concrete, plastic or paint, or any other combination of 2 or more components). This may be a particularly desirable option for small to medium "do-it-yourself" projects by users (e.g., homeowners), offering a cost efficient solution to mix and prepare small quantities of material used in such projects (e.g., concrete), thus alleviating the need to buy or rent expensive mixing equipment (e.g., a cement mixer), as well as eliminating the need (and the cost) for transporting (and returning when renting) such equipment.

In an example use scenario, material (to be mixed) may be poured or placed into the internal space of container/bucket 110, and the mixer insert 100 may then be applied (after attaching the mixing blades 104 to the lid section 102, if needed—e.g., if the blades are offered as separate component). The mixer insert 100 may be secured to the container/bucket 110 (e.g., via the securing means 130), and mixing may then be performed by handling the combination of container/mixer insert in particular manner. For example, using the handle 120, the user may rotate the container/mixer insert back and forth around a rotation axis 140 (as shown in FIG. 1) to facilitate the mixing. In this regard, mixing blades 104 may move through the material as a result of the rotating, thus providing the desired mixing. Other ways for handling the container/mixer insert may be used to achieve the desired mixing. For example, once the mixer insert is applied to the container/bucket 110, the bucket may be put on its side and rolled (e.g., the user's foot, slope of driveway, etc.). In some instance, the mixer insert may be designed to accommodate such alternates means for using it. An example of such modified design is described in more detail with respect to FIG. 2.

Figure 2:
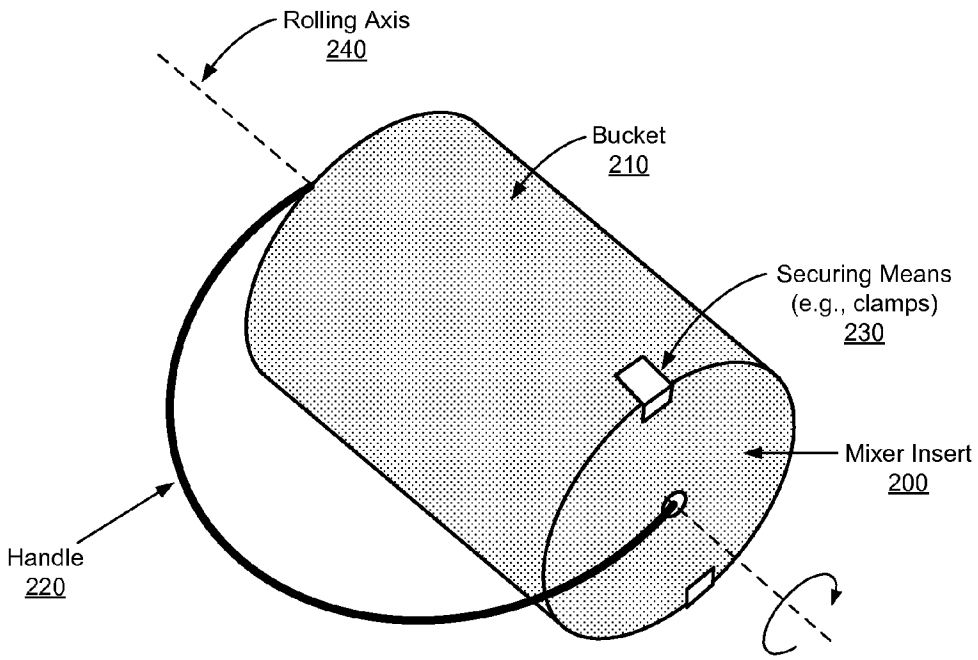
FIG. 2 illustrates an example use of an alternative design of a mixer insert for a bucket, in accordance with an embodiment of the present invention.

FIG. 2 illustrates an example use of an alternative design of a mixer insert for a bucket, in accordance with an embodiment of the present invention. Shown in FIG. 2 is a mixer insert 200, which may be designed and/or manufactured for application to particular containers, to facilitate use of the containers in mixing material for example.

The mixer insert 200 may be substantially similar to the mixer insert 100 of FIG. 1. In this regard, the mixer insert 200 may also comprise an enclosing (e.g., lid section) that is applied to an opening in a container (e.g., bucket) 210, with one or more mixing components (not shown, as the mixer insert 200 is shown to already-be-applied to the container/bucket 200; thus the mixing component(s) would already be inserted within the enclosed space). Also, as with the mixer insert 100, one or more securing components 220 (which may be, in whole or part, part of the mixer insert 200 itself) may be used to secure the mixer insert 200 to the container/bucket 210.

Further, as with the mixer insert 100, a handle 220 may be used to facilitate operation of the combination of the mixer insert 200 and the container/bucket 210 when mixing material. Unlike the handle 120, however, which is part of the container/bucket 100, the handle 220 may be part of the mixer insert 200, and may be designed and/or configured to support the use thereof. For example, the handle 220 may be attached on one end to the center of the mixer insert 200, with the other end (not shown) being adapted such that it may be attached to the opposite (closed) end of the container/bucket 210. This may allow the user to hold the container/bucket 210 (or the combination of the mixer insert 200 and the container/bucket 210) while rolling the container/bucket 210 (e.g., along a rolling axis 240, as shown in FIG. 2).

Figure 3:
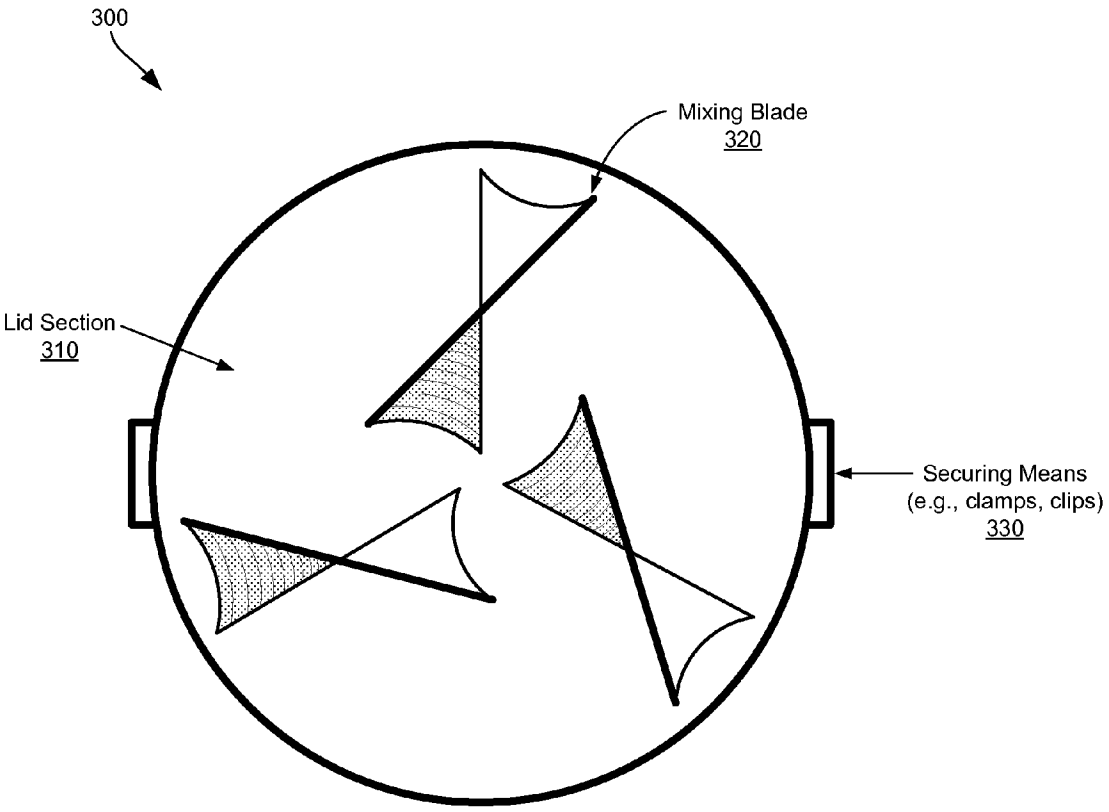
FIG. 3 illustrates an example mixer insert, in accordance with an embodiment of the present invention.

FIG. 3 illustrates an example mixer insert, in accordance with an embodiment of the present invention. Shown in FIG. 3 is a mixer insert 300, which may be applied to particular container, to facilitate use of the container in mixing material for example. The mixer insert 300 may be substantially similar to the mixer insert 100 of FIG. 1, or the mixer insert 200 of FIG. 2. The perspective shown in FIG. 3 may correspond to viewing the mixer insert 300 along the line of application to the container.

The mixer insert 300 may comprise an enclosing (e.g., lid) section 310 configured to match a corresponding opening in any container to which the mixer insert 300 may be applied, one or more mixing components (e.g., blades) 320, and one or more securing related components 330.

The securing related components 330 may be used (on their own, and/or in conjunction with corresponding elements on the containers and/or separate components) to secure the mixer insert 300 to the container to which it is applied. The securing related components 330 may be clamps or clips (or elements thereof).

The enclosing (e.g., lid) section 310 may be shaped to ensure that a space within the container to which the mixer insert 300 is applied would be enclosed. For example, when the container to which the mixer insert 300 is applied is a bucket, the enclosing (e.g., lid) section 310 may be circular shaped, with diameter matching the diameter of the circular opening of the bucket. In some instances, additional means may be used to ensure tight enclosure. For example, a suitable gasket may be inserted between the enclosing section 310 and the corresponding opening in the container to which the mixer insert 300 is applied.

The mixing blades 320 may comprise metal (or other suitable material) based plates adapted such that they would be inserted into and/or fit within the space enclosed in the container when the mixer insert 300 is applied to it. For example, the mixing blades 320 may be attached to the enclosing section 310, protruding from the surface that would face the opening to which the enclosing section 310 is applied, such that such that they would be fit within the spaced enclosed when the enclosing section 310 is applied to the opening. The material used in constructing the mixing blade may be selected such that it may be appropriate for the mixing performed within the container. For example, the mixing blades 320 may be formed of mild steel or other similarly strong material (metal or otherwise). Further, in some instances, the mixing blades 320 may be shaped to enhance the mixing function performed thereby. For example, as shown in the example implementation depicted in FIG. 3, the mixing blades 320 may be twisted or spiraled along their length, which may help ease and/or enhance the movement of the blades through the material being mixed, thus improving the mixing performance thereof.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. An apparatus, comprising:

a mixer insert that comprises:

an enclosing component adapted for application to an opening in a container to which the mixer insert is applied, to enclose a space in the container; and one or more mixing components, adapted to fit within the enclosed space when the enclosing component is applied to the opening in the container, wherein:

the one or more mixing components are configured to mix material placed within the enclosed space when the combination of the container and the mixer insert is subject to particular force or movement; and the combination of the container and the mixer insert is configured such that the material placed in the enclosed space is mixed only when the particular force or movement is applied to the combination of the container and the mixer insert as a whole.

2. The apparatus of claim 1, wherein the force or movement comprises rolling the combination of the container and the mixer insert along a particular rolling axis.

3. The apparatus of claim 1, wherein the force or movement comprises rotating the combination of the container and the mixer insert back and forth, around a particular rotation axis.

4. The apparatus of claim 1, wherein:

the container comprises a cylindrical shaped object, opened at one circular end and closed on an opposite circular end; and the enclosing component comprises a circular shaped section that is adapted for application to the open circular end.

5. The apparatus of claim 1, wherein each of the one or more mixing components comprises a blade.

6. The apparatus of claim 5, wherein the blade is twisted along the length of the blade.

7. The apparatus of claim 1, comprising one or more securing components for securing the mixer insert to the container.

8. The apparatus of claim 7, wherein the one or more securing components are incorporated into the mixer insert.

9. The apparatus of claim 7, wherein each of the one or more securing components comprises a clamp or a clip based component.

10. The apparatus of claim 1, comprising a handling component adapted for enabling handling of the combination of the container and the mixer insert.

11. The apparatus of claim 10, wherein the handling component is incorporated into or attached to the mixer insert itself.

12. The apparatus of claim 10, wherein the handling component is configured to enable or support applying the particular force or movement when mixing the material placed within the enclosed space.

13. A mixer insert, comprising:

an enclosing component adapted for application to an opening in a container to which the mixer insert is applied, to enclose a space in the container; and one or more mixing components, adapted to fit within the enclosed space when the enclosing component is applied to the opening in the container;

wherein:

the one or more mixing components are configured to mix material placed within the enclosed space when the combination of the container and the mixer insert is subject to particular force or movement;

the combination of the container and the mixer insert is configured such that the material placed within the enclosed space is mixed only when the particular force or movement is applied to the combination of the container and the mixer insert as a whole.

14. The mixer insert of claim 13, wherein the enclosing component comprises a circular shaped section that is adapted for application to containers having circular openings.

15. The mixer insert of claim 13, wherein each of the one or more mixing components comprises a blade.

16. The mixer insert of claim 15, wherein the blade is twisted along the length of the blade.

17. The mixer insert of claim 13, comprising one or more securing components for securing the mixer insert to the container.

18. The mixer insert of claim 17, wherein each of the one or more securing components comprises a clamp or a clip based component.

19. The mixer insert of claim 13, comprising a handling component adapted for enabling handling of the combination of the container and the mixer insert.

20. The mixer insert of claim 19, wherein the handling component is configured to enable or support applying the particular force or movement when mixing the material placed within the enclosed space.

* * * * *